US006343956B2

(12) United States Patent
Stickney

(10) Patent No.: US 6,343,956 B2
(45) Date of Patent: Feb. 5, 2002

(54) CIRCUIT BOARD MOUNTED CONNECTOR GROUND

(75) Inventor: William Stickney, Cresco, PA (US)

(73) Assignee: Laird Technologies Inc., Delaware Water Gap, PA (US)

( * ) Notice: Subject to any disclaimer, the term of this patent is extended or adjusted under 35 U.S.C. 154(b) by 0 days.

(21) Appl. No.: 09/764,577

(22) Filed: Jan. 18, 2001

Related U.S. Application Data

(60) Provisional application No. 60/176,526, filed on Jan. 18, 2000.

(51) Int. Cl.[7] ..... H01R 13/648
(52) U.S. Cl. ..... 439/609; 439/939
(58) Field of Search ..... 439/607, 609, 439/79, 939

(56) References Cited

U.S. PATENT DOCUMENTS 6,193,552 B1 * 2/2001 Chiou et al. ..... 439/607
6,193,554 B1 * 2/2001 Wu ..... 439/607

* cited by examiner

*Primary Examiner*—Khiem Nguyen

(57) ABSTRACT

A connector ground for mounting on a circuit board is provided which includes an upper surface with a U-shaped slot defining a tab. The upper surface further includes an obliquely upwardly extending spring finger. When the spring finger is free of external contact, the tab is coplanar with the upper surface so that the tab does not contact a shielded connector which is mounted to the circuit board and straddled by the connector ground. However, when the spring finger contacts the face plate or similar structure of the enclosure after the circuit board has been installed, both the spring finger and the tab rotate so that the tab contacts the shielded connector.

11 Claims, 5 Drawing Sheets

CIRCUIT BOARD MOUNTED CONNECTOR GROUND

The present application claims priority from provisional U.S. patent application Ser. No. 60/176,526 filed on Jan. 18, 2000.

BACKGROUND OF THE INVENTION

1. Field of the Invention

The invention pertains to a connector ground which mounts on a circuit or P.C. board so as to straddle a shielded connector. In particular, the ground includes a tab which is coplanar with a surface during the assembly of the connector ground to the P.C. board and thereby does not contact the straddled connector. However, the tab rotates in concert with a spring finger when the board is placed or installed into an enclosure thereby contacting the connector which is straddled by the connector ground.

2. Description of the Prior Art

In the prior art, connector grounds which ground a shielded connector to a circuit or P.C. board are known. Connector grounds allow higher input/output speed between computers and peripherals. However, clearance is required between the connector ground and the shielded connector during the mounting of the connector ground due to the tolerance of the assembly process. Therefore, in order to provide electrical communication between the connector ground and the shielded connector, these connector grounds typically require pre-assembly to the shielded connector prior to the installation of the circuit board into the enclosure. Furthermore, it is extremely important that the connector ground be in secure electrical communication with the shielded connector after the circuit board is installed within the enclosure or similar support.

Representative prior art includes grounding springs which mount on a shielded connector and shunt electrical current into an enclosure through spring fingers. Other prior art includes U.S. Pat. No. 4,864,076.

OBJECTS AND SUMMARY OF THE INVENTION

It is therefore an object of the present invention to eliminate the pre-assembly of the connector ground to the shielded connector prior to the installation of the circuit board into the enclosure or similar structure.

It is therefore a still further object of the present invention to provide a connector ground which has a secure electrical connection to a straddled shielded connector on a circuit board after the circuit board has been installed into an enclosure or similar structure.

These and other objects are attained by providing a connector ground which includes a spring finger on a surface and at least one U-shaped slot on the surface thereby resulting in a tab therewithin. When the spring finger is free of engagement, the tab is unflexed and therefore coplanar with the surface during assembly so that the tab does not touch a shielded connector straddled by the connector ground. However, when the board is installed into the enclosure or similar structure, the spring finger interferes with the enclosure causing the spring finger and the tab to flex or rotate so that the tab electrically and mechanically engages the shielded connector.

BRIEF DESCRIPTION OF THE DRAWINGS

Further objects and advantages of the invention will become apparent from the following description and claims, and from the accompanying drawings, wherein:

DETAILED DESCRIPTION OF THE PRESENT INVENTION

Figure 1:
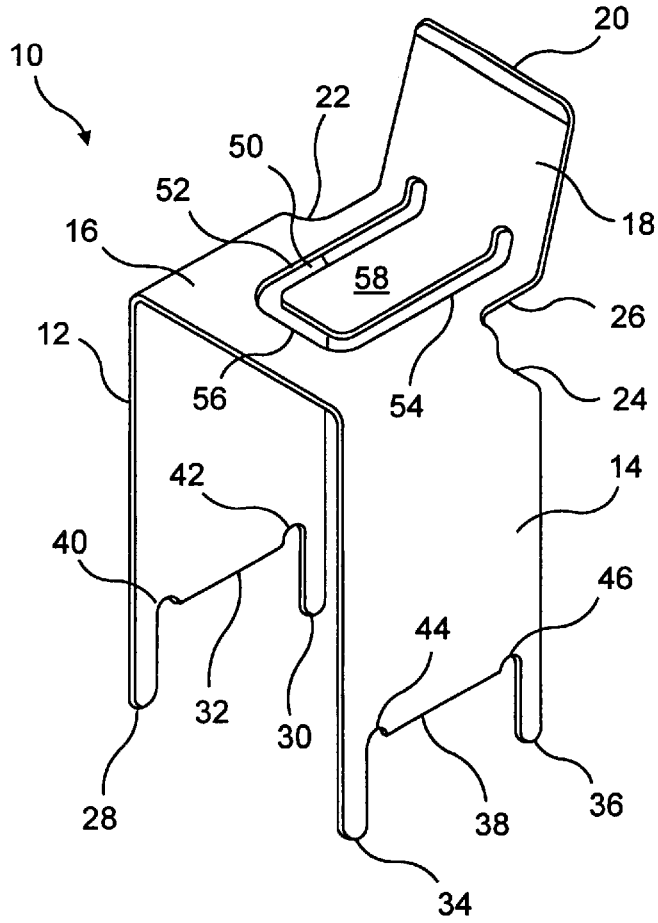
FIG. 1 is a perspective view of the connector ground of the present invention.
Figure 2:
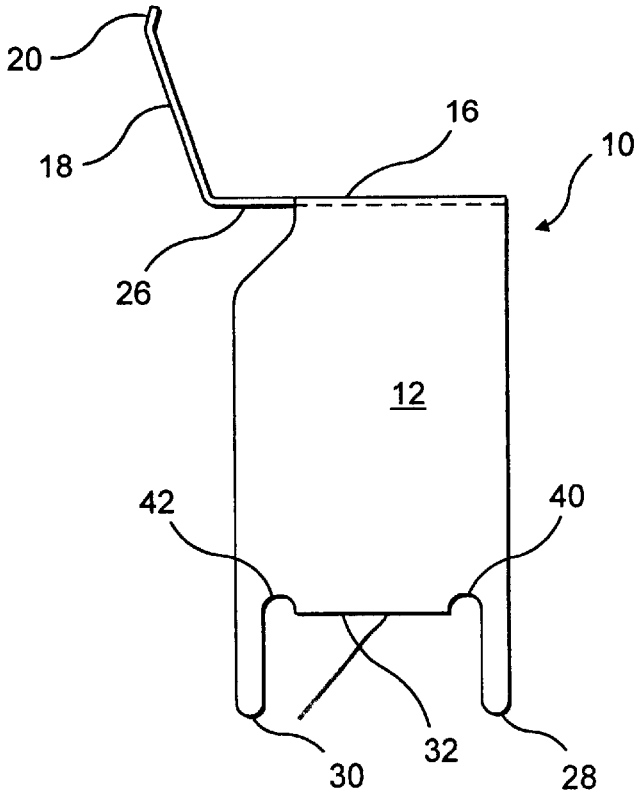
FIG. 2 is a side plan view of the connector ground of the present invention.
Figure 3:
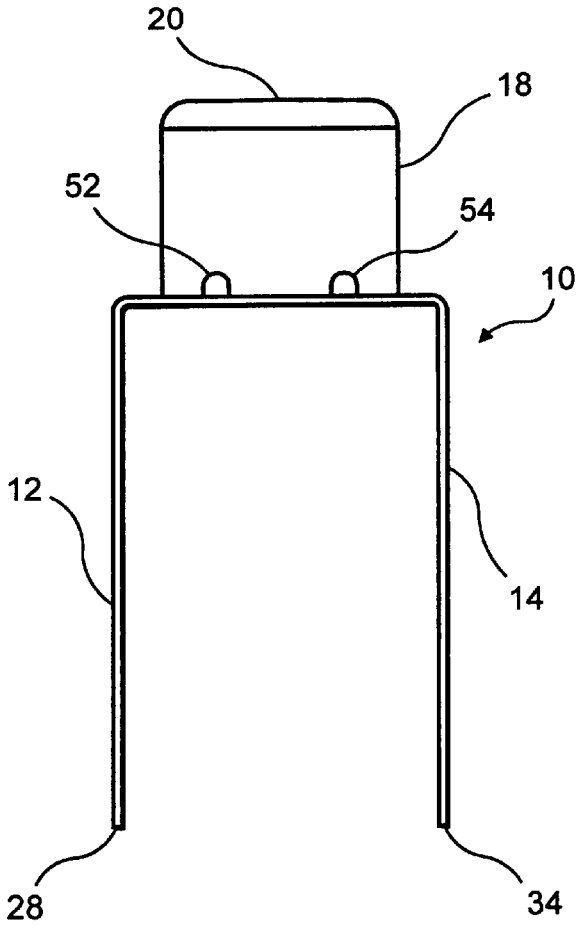
FIG. 3 is a front plan view of the connector ground of the present invention.
Figure 4:
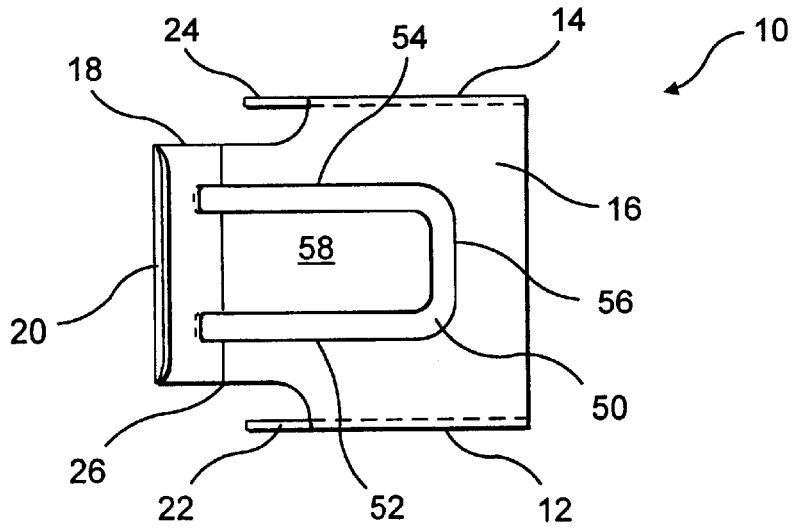
FIG. 4 is a top plan view of the connector ground of the present invention.
Figure 10:
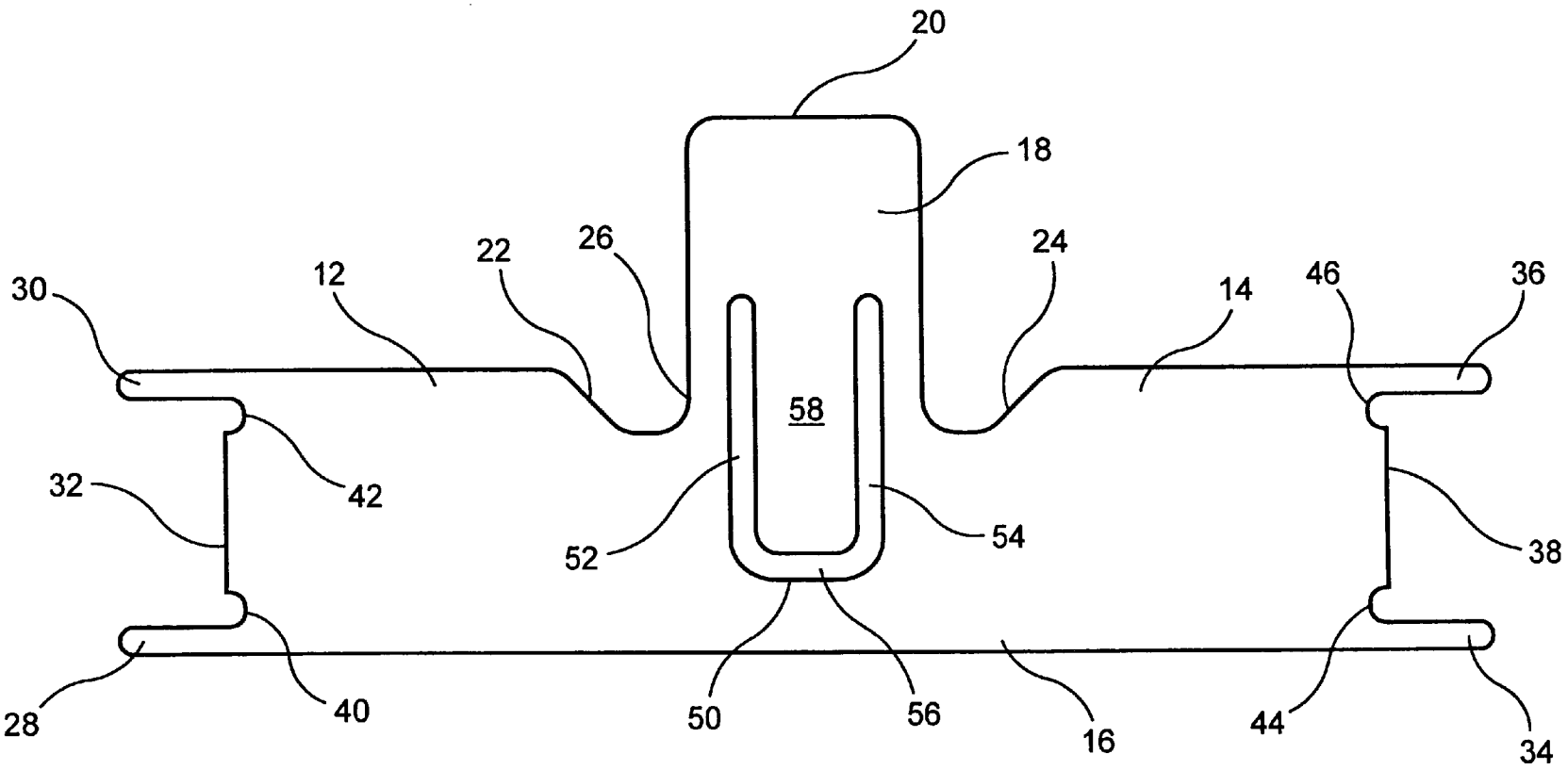
FIG. 10 is a plan view of the shape of sheet metal which is formed in the initial manufacturing of the connector ground of the present invention.

Referring now to the drawings in detail wherein like numerals refer to like elements throughout the several views, one sees that FIG. 1 is a perspective view of the connector ground 10 of the present invention, with FIGS. 2, 3 and 4 illustrating the various plan views of the connector ground 10. Connector ground 10 includes planar vertical sidewalls 12, 14 which are parallel with each other, and which are integral with and support upper surface 16. Spring finger 18 extends obliquely upward from upper surface 16 and terminates in angled lip 20. In fact, as can be seen from FIG. 10, connector ground 10 is formed from a single piece of stamped sheet metal which is typically 0.008 inch copper beryllium, bright tin plate, but those skilled in the art will realize that other thicknesses and materials may be appropriate for various applications.

Sidewalls 12, 14 include undercuts 22, 24, respectively, which result in a portion 26 of upper surface 16 being cantilevered. Portion 26 of upper surface 16 joins to spring finger 18. Connector pins 28, 30 are formed on opposite ends of the lower surface 32 of sidewall 12. Likewise, connector pins 34, 36 are formed on opposite ends of the lower surface 38 of sidewall 14. Semi-circular reliefs 40, 42 are formed inwardly adjacent from connector pins 28, 30 on lower surface 32 of sidewall 12. Likewise, semi-circular reliefs 44, 46 are formed inwardly adjacent from connector pins 34, 36, respectively, on lower surface 38 of sidewall 14. As shown in FIGS. 5, 6, 7 and 8, connector pins 28, 30, 34, 36 are inserted and soldered into apertures 102 of circuit board 100 during the mounting of connector ground 10 onto circuit board 100. Semi-circular reliefs 40, 42, 44, 46 avoid sharp corners during the tooling process while maintaining the straightness of lower surfaces 32, 38 for contact with circuit board 100.

U-shaped slot 50 is formed on upper surface 16. U-shaped slot 50 includes slot legs 52, 54 which extend somewhat into spring finger 18. Slot span 56 joins slot legs 52, 54. Tab 58 is therefore defined within U-shaped slot 50. When no external pressure is applied to spring finger 18, tab 58 remains coplanar within upper surface 16 as shown in FIGS. 1–6.

Figure 5:
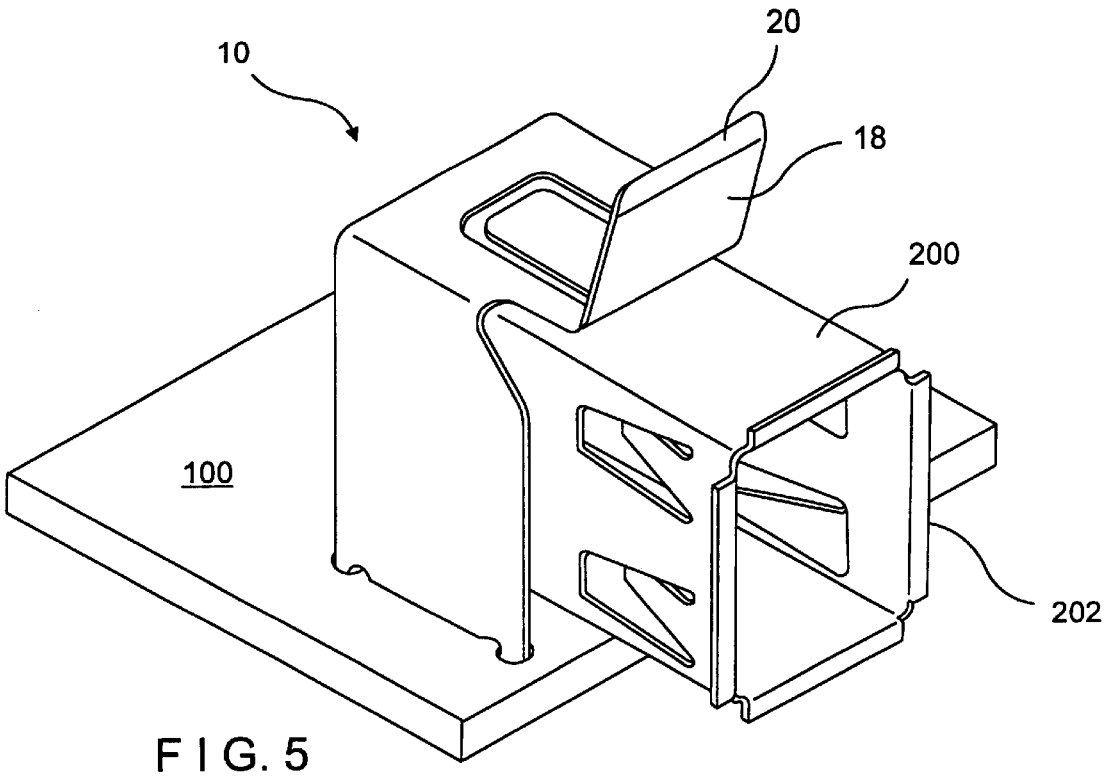
FIG. 5 is a front perspective view of the connector ground of the present invention mounted on a circuit board so as to straddle a connector.
Figure 6:
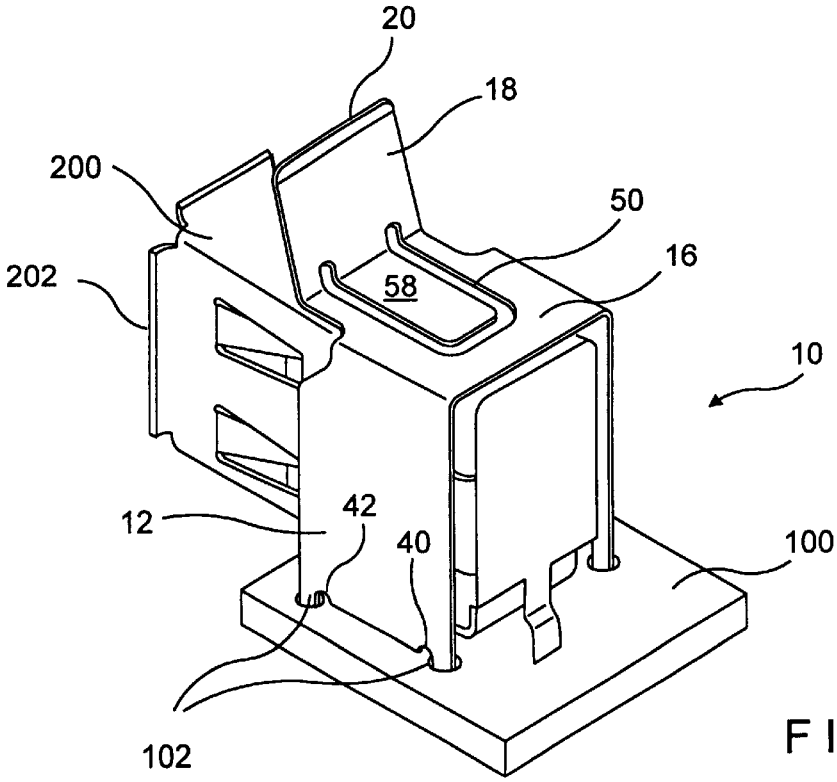
FIG. 6 is a rear perspective view of the connector ground of the present invention mounted on a circuit board so as to straddle a connector.
Figure 8:
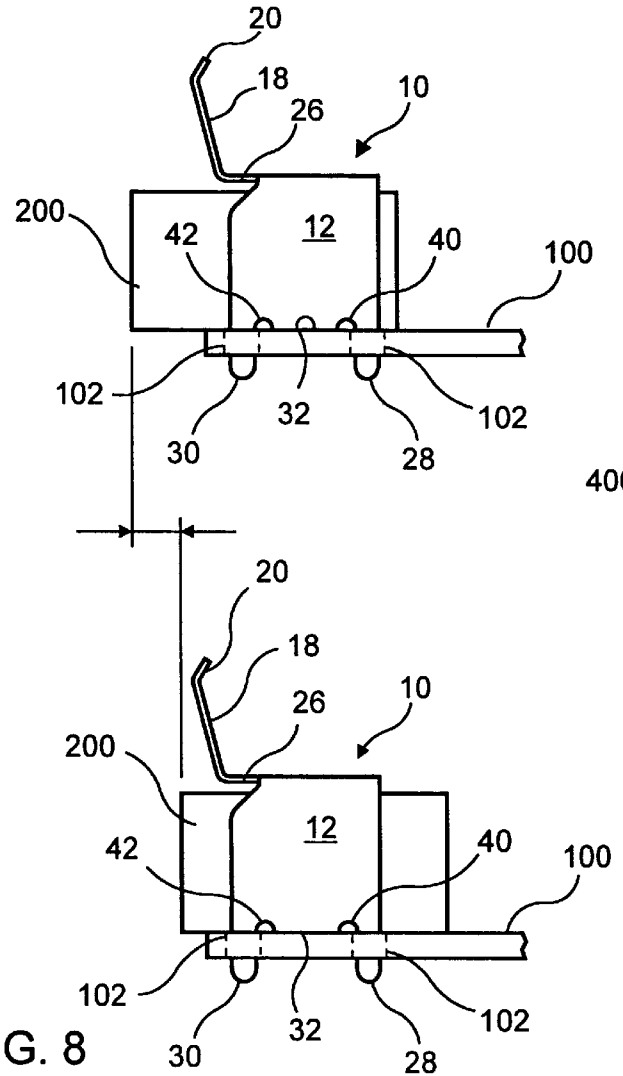
FIG. 8 illustrates the range of mounting positions for a connector which is straddled by the connector ground of the present invention.
Figure 7:
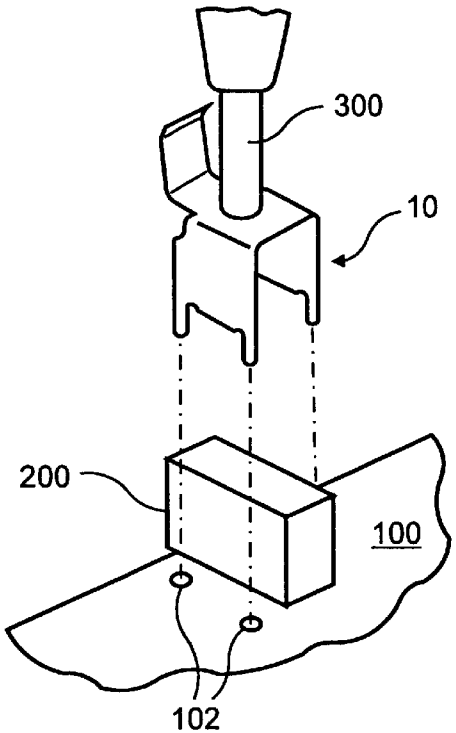
FIG. 7 is a perspective view of the mounting of the connector ground of the present invention to a circuit board so as to straddle a connector.

FIGS. 5 and 6 show the connector ground 10 mounted on circuit board 100 so as to straddle, but not touch, shielded connector 200. The mounting process, as shown in FIG. 7, is typically done by a vacuum pick-up 300. Shielded connector 200 is illustrated as an IEEE-1394 connector shield which further includes port 202 for receiving a jack of an external cable (not shown). FIG. 8 illustrates a range of mounting positions which are acceptable for shielded connector 200 with respect to connector ground 10 and circuit board 100.

Figure 9:
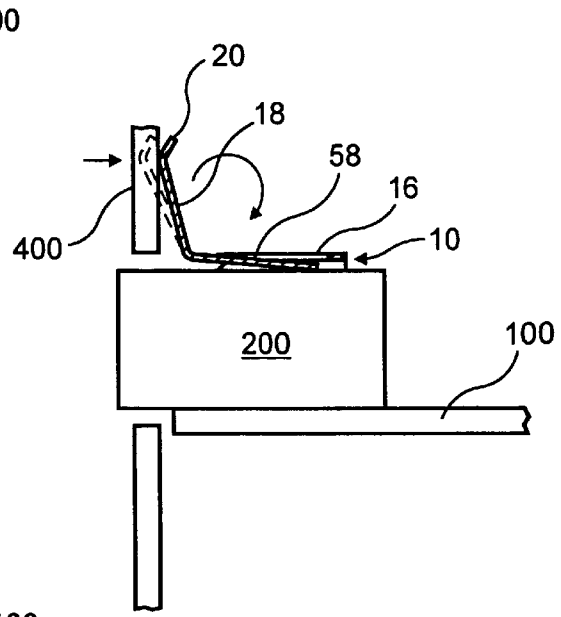
FIG. 9 is a side view, partially in cross section, showing the installed position of the mounted connector ground of the present invention, wherein the tab of the connector ground has rotated to form an electrical connection with the connector.

FIG. 9 illustrates that when circuit board 100 is installed into an enclosure or similar structure with face plate 400, that spring finger 18 interferes with the face plate 400 of the enclosure causing the spring finger 18 and the tab 58 to flex or rotate so that the tab 58 electrically and mechanically engages the shielded connector 200. Preferably, this occurs automatically in response to the installation of the circuit board and requires no additional special step to cause this rotation.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A connector ground including:

a plurality of walls;

a connection element for connecting at least one of said walls to a circuit board whereby a space is defined by said plurality of walls and the circuit board;

said plurality of walls including a first wall, said first wall including an extended portion;

at least one slot formed in said first wall thereby defining a tab formed from said first wall; and whereby flexing of said extended portion causes at least a portion of said tab to rotate into said space.

2. The connector ground of claim 1 wherein said plurality of walls includes a top wall and two sidewalls, wherein said first wall comprises said top wall and wherein said connection element is formed on an edge of said sidewalls.

3. The connector ground of claim 2 wherein said connection element comprises pins formed substantially coplanarly with said sidewalls.

4. The connector ground of claim 3 wherein said extended portion extends at an angle from said top wall.

5. The connector ground of claim 4 wherein said angle extends upwardly and away from said top wall.

6. The connector ground of claim 5 wherein said extended portion is constructed and arranged to interfere with a surface formed substantially perpendicularly with the circuit board thereby flexing said extended portion and causing at least a portion of said tab to rotate into said space.

7. The connector ground of claim 6 wherein undercuts are formed on a portion of said sidewalls immediately adjacent to said top wall.

8. The connector ground of claim 7 wherein said sidewalls are formed perpendicular to said top wall.

9. The connector ground of claim 8 wherein said at least one slot is U-shaped and formed in said top wall and said extended portion.

10. The connector ground of claim 9 wherein the connector ground is initially formed from a single planar section of conductive material.

11. The connector ground of claim 10 wherein said conductive material is sheet metal.

* * * * *